US007250223B2

(12) United States Patent
Miyachi et al.

(10) Patent No.: US 7,250,223 B2
(45) Date of Patent: Jul. 31, 2007

(54) ALUMINUM HEAT EXCHANGER EXCELLENT IN CORROSION RESISTANCE

(75) Inventors: Haruhiko Miyachi, Okazaki (JP); Yoshiharu Hasegawa, Obu (JP); Masamichi Makihara, Anjo (JP); Yasunaga Itoh, Nagoya (JP); Naoki Yamashita, Nagoya (JP); Toshihiko Fukuda, Obu (JP)

(73) Assignees: DENSO Corporation, Aichi (JP); Sumitomo Light Metal Industries, Ltd., Tokyo (JP)

( * ) Notice: Subject to any disclaimer, the term of this patent is extended or adjusted under 35 U.S.C. 154(b) by 0 days.

(21) Appl. No.: 10/860,560

(22) Filed: Jun. 3, 2004

(65) Prior Publication Data

US 2005/0011636 A1 Jan. 20, 2005

(30) Foreign Application Priority Data

Jun. 6, 2003 (JP) ..... 2003-161863
May 26, 2004 (JP) ..... 2004-155813

(51) Int. Cl.

| | |
|---|---|
| ***F28F 23/00*** | (2006.01) |
| ***F28F 1/12*** | (2006.01) |
| ***F28F 1/42*** | (2006.01) |
| ***F28F 21/08*** | (2006.01) |
| ***B32B 7/02*** | (2006.01) |
| ***B32B 15/01*** | (2006.01) |
| ***B32B 15/20*** | (2006.01) |

(52) U.S. Cl. ..... 428/654; 428/457; 165/133; 165/58; 165/151; 165/180; 165/905

(58) Field of Classification Search ..... 428/654; 165/133, 905, 904

See application file for complete search history.

(56) References Cited

U.S. PATENT DOCUMENTS

| | | | | |
|---|---|---|---|---|
| 5,217,547 | A * | 6/1993 | Ishikawa et al. | 148/552 |
| 6,129,143 | A * | 10/2000 | Hasegawa et al. | 165/133 |
| 6,261,706 | B1 * | 7/2001 | Fukuda et al. | 428/654 |
| 6,316,126 | B1 * | 11/2001 | Hasegawa et al. | 428/654 |
| 6,361,882 | B1 * | 3/2002 | Shoji et al. | 428/654 |
| 6,387,540 | B1 * | 5/2002 | Yoshidomi et al. | 428/654 |
| 6,465,113 | B2 * | 10/2002 | Yamada et al. | 428/654 |
| 2006/0086486 | A1 * | 4/2006 | Sudo | 165/143 |

* cited by examiner

*Primary Examiner*—John J. Zimmerman
*Assistant Examiner*—Jason L. Savage
(74) *Attorney, Agent, or Firm*—Flynn, Thiel, Boutell & Tanis, P.C.

(57) ABSTRACT

The present invention provides a heat exchanger which is assembled by brazing an aluminum fin material to the outer surface of an aluminum tube material formed by bending a sheet material, in particular, an aluminum heat exchanger which can be suitably used as an automotive heat exchanger such as a condenser or evaporator. The tube material is formed of a two-layer clad sheet which includes a core material and an Al—Zn alloy layer clad on the core material. The Al—Zn alloy layer is clad on the outer surface of the tube material and brazed to the aluminum fin material. The potential of the Al—Zn alloy layer in a normal corrosive solution is at least 100 mV lower than the potential of the core material in the normal corrosive solution. The potential of the Al—Zn alloy layer in the normal corrosive solution is lower than the potential of the core material in high-concentration corrosive water. The normal corrosive solution refers to an aqueous solution containing 10 g/l of NaCl and 0.3 g/l of $Na_2SO_4$, and the high-concentration corrosive water refers to an aqueous solution in which the NaCl concentration is increased by 30 times by concentrating the above aqueous solution.

13 Claims, 4 Drawing Sheets

ALUMINUM HEAT EXCHANGER EXCELLENT IN CORROSION RESISTANCE

BACKGROUND OF THE INVENTION

1. Field of the Invention

The present invention relates to an aluminum heat exchanger having excellent corrosion resistance. More particularly, the present invention relates to an aluminum heat exchanger in which the corrosion resistance of a tube material is improved in an automotive heat exchanger which is assembled by brazing an aluminum fin material to the outer surface of a tube material made of aluminum (including an aluminum alloy) formed by bending a sheet material.

2. Description of Background Art

An automotive aluminum heat exchanger, such as a condenser or an evaporator, is generally manufactured by brazing a tube in which a refrigerant flows and a fin which exchanges heat with the outside. It is important to protect the outer surface of the tube material against corrosion in order to secure corrosion resistance of the heat exchanger. Conventionally, the outer surface of the tube material is protected against corrosion by using a method of utilizing sacrificial corrosion of the fin material or a method of forming a Zn diffusion layer on the surface of the tube material.

However, in the case where low chlorine ion water serves as a corrosion environment, such as an evaporator, since it is difficult to obtain a potential necessary for corrosion protection in the area apart from the joint section between the tube and the fin by using the method of utilizing sacrificial corrosion of the fin material, sufficient corrosion protection of the tube cannot be achieved.

In the method of forming a Zn diffusion layer on the surface of the tube material to protect the tube material against corrosion by utilizing the sacrificial corrosion effect of the outer surface of the tube, the Zn diffusion layer is formed on the surface of the tube material by Zn thermal spraying when an extruded tube is used as the tube material, and a fin formed of a brazing sheet on which an Al—Si alloy filler metal is clad is brazed to the tube. In the case where a tube formed by bending a sheet material is used as the tube material, a tube material formed by bending a sheet material on which an Al—Si alloy filler metal containing Zn is clad on the surface is brazed to a bare fin on which a filler metal is not clad (see Japanese Patent Application Laid-open No. 2001-71172). It is advantageous to use the bare fin instead of a fin formed of a brazing sheet from the viewpoint of surface treatment capability, thermal conductivity, and brazeability.

In recent years, a reduction of the thickness of the heat exchanger material has been strongly demanded accompanying a demand for a reduction of the weight of the heat exchanger due to a reduction of the weight of vehicles. From this viewpoint, it is difficult to reduce the thickness to a large extent by the method of using an extruded tube as the tube material. The thickness can be reduced by using a tube formed by bending a sheet material as the tube material. However, sufficient corrosion resistance cannot necessarily be secured since the Zn diffusion layer is rapidly consumed.

The outline of corrosion of an aluminum heat exchanger formed by brazing a tube material to a fin material is described below. As shown in FIG. 1, a bare fin 1 formed of an Al—Mn alloy is combined with a tube material 2 formed by bending a sheet material in which an Al—Si alloy filler metal containing Zn is clad on an aluminum alloy core material 4. When the bare fin 1 and the tube material 2 are heated for brazing, a Zn diffusion layer 3 is formed on the surface of the tube material 2, and the filler metal 3 is melted to form a fillet F, whereby the bare fin 1 and the tube material 2 are brazed.

The potential of the surface of the tube material 2 must be lower than the potential of the core material 4 of the tube material 2 from the viewpoint of corrosion protection of the tube material 2. In order to decrease the potential of the surface of the tube material, Zn is added to the Al—Si alloy filler metal 3, and the Zn diffusion layer 3 is formed on the surface of the tube material 2 during heating for brazing. However, since consumption of the Zn diffusion layer in a normal corrosive solution is increased due to Si diffused together with Zn, penetration corrosion tends to occur directly under or near the brazed section in the early stages.

A method which aims at solving the above problem instead of the method of forming the Zn diffusion layer by using a tube material formed by bending a sheet material in which an Al—Zn alloy is clad on the outer surface of a core material formed of an Al—Mn alloy equivalent to A3003 or A3103 as the tube material, and forming a sacrificial corrosion layer with a small corrosion rate by brazing an aluminum fin material to the Al—Zn alloy layer formed on the outer surface of the tube material has been proposed (see Japanese Patent Application Laid-open No. 2001-50690). However, this method does not necessarily provide sufficient corrosion resistance depending on the use environment of the automotive aluminum heat exchanger.

SUMMARY OF THE INVENTION

The present inventors have conducted various tests and studies on the measure of improving the corrosion resistance of the tube material in order to provide excellent corrosion resistance to an aluminum heat exchanger assembled by brazing an aluminum tube material formed by bending a sheet material which enables a reduction of the thickness as the tube material to an aluminum fin material in the actual use environment. As a result, the present inventors have found the following facts.

Specifically, in the evaluation of corrosion resistance of the brazed section or the constituent members of the aluminum heat exchanger, corrosion protection properties are evaluated by using the same concentration of a corrosive solution, such as in a continuous spraying method such as a CASS test. However, in the actual use environment for the automotive aluminum heat exchanger, the concentration of corrosive water is not constant, since wet and dry conditions repeatedly occur. For example, since water tends to adhere near the brazed section of the fin, chlorine ion or the like is expected to concentrate. Since aluminum has different potentials depending on the chlorine ion concentration in corrosive water, sufficient corrosion resistance cannot be achieved unless the chlorine ion concentration corresponding to the actual use environment is taken into consideration. In order to evaluate practical corrosion resistance, it is necessary to evaluate corrosion resistance taking this point into consideration.

The present invention has been achieved based on the above findings. An object of the present invention is to provide an aluminum heat exchanger having excellent corrosion resistance which is assembled by brazing an aluminum fin material to the outer surface of an aluminum tube material formed by bending a sheet material, includes a tube material having practically improved corrosion resistance, and is suitably used as an automotive heat exchanger.

In order to achieve the above object, one aspect of the present invention provides an aluminum heat exchanger having excellent corrosion resistance which is assembled by brazing an aluminum fin material to an outer surface of a tube material made of aluminum formed by bending a sheet material, wherein the tube material is formed of a two-layer clad sheet which includes a core material and an Al—Zn alloy layer clad on the core material, the Al—Zn alloy layer is clad on the outer surface of the tube material and brazed to the aluminum fin material, a potential (natural potential, hereinafter the same) of the Al—Zn alloy layer in a normal corrosive solution is at least 100 mV lower than the potential of the core material in the normal corrosive solution, and the potential of the Al—Zn alloy layer in the normal corrosive solution is lower than the potential of the core material in high-concentration corrosive water. The normal corrosive solution refers to an aqueous solution containing 10 g/l of NaCl and 0.3 g/l of $Na_2SO_4$, and the high concentration corrosive water refers to an aqueous solution in which the NaCl concentration is increased by 30 times by concentrating the above aqueous solution.

In this aluminum heat exchanger having excellent corrosion resistance, the potential of a brazed section between the Al—Zn alloy layer of the tube material and the aluminum fin material in the corrosive water may be at least 100 mV lower than the potential of the core material in the corrosive water, and the potential of the brazed section between the Al—Zn alloy layer of the tube material and the aluminum fin material in the corrosive water may be lower than the potential of the core material of the tube material in the high-concentration corrosive water.

In this aluminum heat exchanger having excellent corrosion resistance, the Al—Zn alloy layer of the tube material may comprise 2.0-7.5% of Zn.

In this aluminum heat exchanger having excellent corrosion resistance, the core material of the tube material may be an Al—Mn alloy.

In this aluminum heat exchanger having excellent corrosion resistance, the Al—Mn alloy may comprise more than 1.5% of Mn.

In this aluminum heat exchanger having excellent corrosion resistance, the tube material may have a thickness of 100-300 μm, and the thickness of a sacrificial anode material may be 10-40% of the thickness of the tube material.

In this aluminum heat exchanger having excellent corrosion resistance, the aluminum fin material on which an Al—Si alloy filler metal is clad may be brazed to an inner surface of the tube material.

In this aluminum heat exchanger having excellent corrosion resistance, the tube material may be formed of a three-layer clad sheet in which an Al—Si alloy filler metal is further clad on the core material of the two-layer clad sheet, the Al—Si alloy filler metal may be clad on the inner surface of the tube material, and the aluminum fin material may be brazed to the inner surface of the tube material.

In this aluminum heat exchanger having excellent corrosion resistance, the tube material may have a thickness of 100-300 μm, the thickness of a sacrificial anode material may be 10-40% of the thickness of the tube material, and the thickness of the Al—Si alloy filler metal may be 5-30% of the thickness of the tube material.

In this aluminum heat exchanger having excellent corrosion resistance, the aluminum fin material on which an Al—Si alloy filler metal is clad may be brazed to the outer surface of the tube material.

In this aluminum heat exchanger having excellent corrosion resistance, the aluminum fin material in which an Al—Si alloy is clad may be brazed to the outer surface of the tube material using a powdered filler metal.

In this aluminum heat exchanger having excellent corrosion resistance, at least one of the Al—Si alloy filler metal and the aluminum fin material may comprise 0.3-3.0% of Zn.

In this aluminum heat exchanger having excellent corrosion resistance, the aluminum fin material may comprise 0.3-3.0% of Zn.

According to the present invention, an aluminum heat exchanger having excellent corrosion resistance which is assembled by brazing an aluminum fin material to the outer surface of an aluminum tube material formed by bending a sheet material, includes a tube material having improved corrosion resistance, and has excellent corrosion resistance can be provided. The aluminum heat exchanger can be suitably used as an automotive heat exchanger such as a condenser or evaporator.

Other objects, features, and advantages of the invention will hereinafter become more readily apparent from the following description.

DESCRIPTION OF PREFERRED EMBODIMENT OF THE INVENTION

As a tube material, each of a sheet material in which an Al-2.2% Zn alloy was clad on the outer surface of a core material made of an Al-1.2% Mn alloy (thickness: 0.15 mm) (specimen No. 1), and a sheet material in which an Al-7.5% Si-5.0% Zn alloy was clad on the outer surface of a core material made of an Al-1.2% Mn alloy (thickness: 0.15 mm) (specimen No. 2) was assembled with a corrugated fin material in which an A1—Si alloy filler metal was clad on an Al—Mn alloy core material. The materials were brazed by inert gas brazing using a fluoride-type flux. The resulting brazed products were subjected to a controlled potential electrolysis test.

Figure 1:
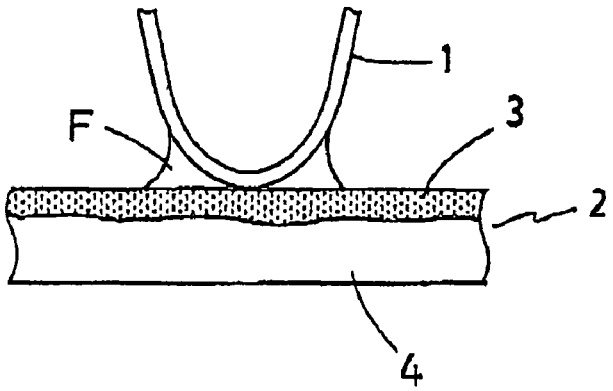
FIG. 1 is a partial cross-sectional view showing a brazed section between a tube material and a fin material in an aluminum heat exchanger.
Figure 2:
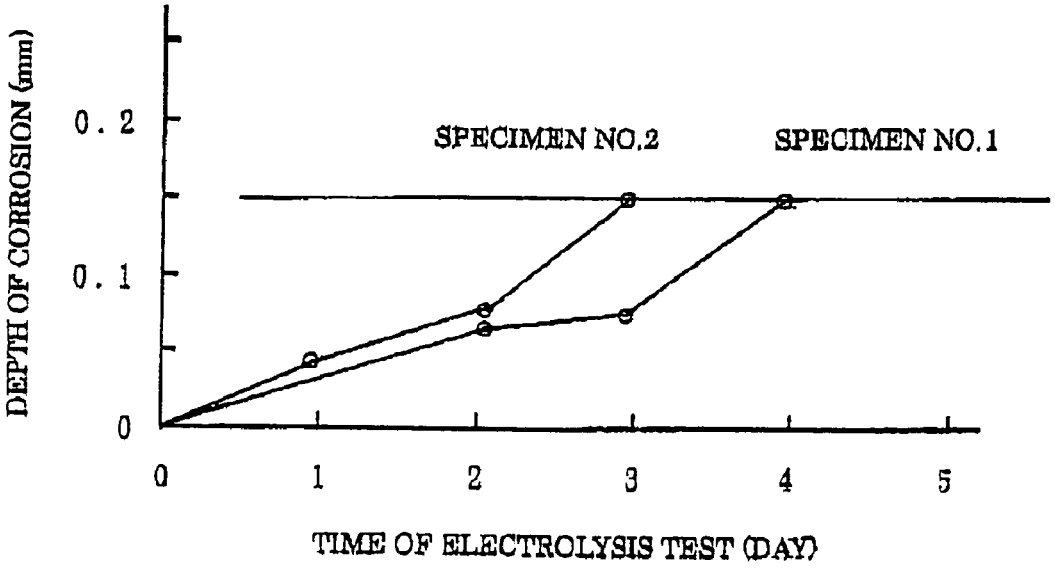
FIG. 2 is a view showing results for a controlled potential electrolysis test on a tube material of a heat exchanger of the present invention in contrast with a conventional tube material.

The potential applied was −570 mV vs Ag/AgCl. A solution to which 10 g/l of NaCl and 0.3 g/l of $Na_2SO_4$ were added was used as a corrosive solution. As shown in FIG. 2, the test results show that the specimen No. 1 on which the Al—Zn alloy was clad had better corrosion resistance than the specimen No. 2 on which the Al—Si—Zn alloy was clad. It is estimated that early corrosion occurred in the Zn diffusion layer of the specimen No. 2 on which the Al—Si—Zn alloy was clad due to the effects of Si. It was confirmed that the tube material on which the Al—Zn alloy layer which does not contain Si is clad is better from the viewpoint of corrosion resistance.

Figure 3:
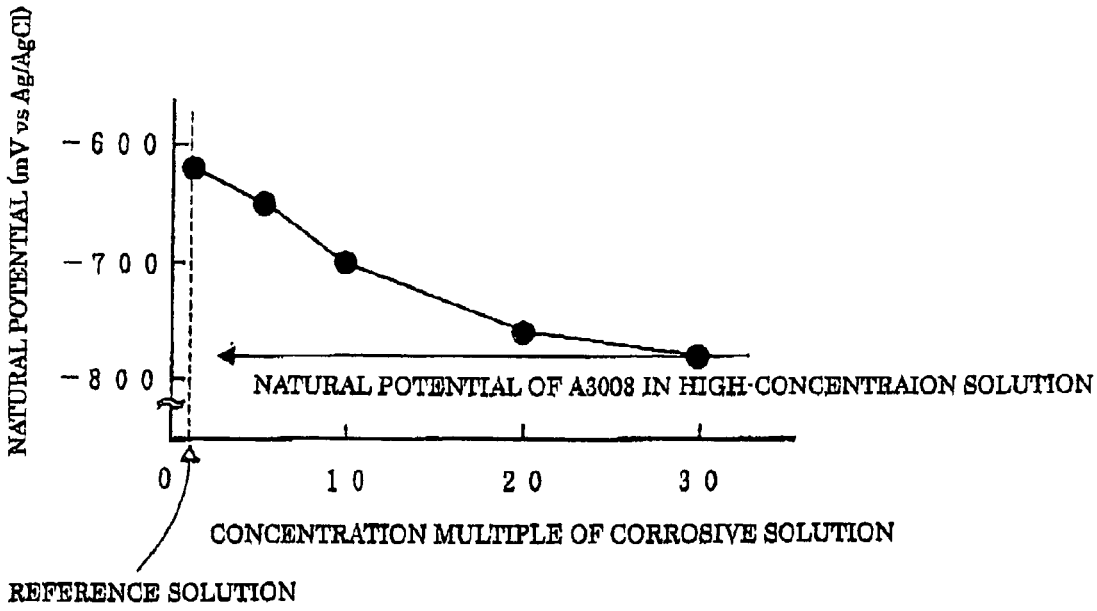
FIG. 3 is a view showing the relationship between a natural potential of an A3003 alloy and the concentration of a corrosive solution.

The potential of an A3003 alloy (Al—Mn alloy) generally used as a core material of a tube material in a normal corrosive solution and a change in potential in concentrated water obtained by concentrating corrosive water are described below. As the normal corrosive solution, a solution to which 10 g/l of NaCl and 0.3 g/l of $Na_2SO_4$ were added was used as a reference solution. The potential was measured in a solution in which the chlorine ion concentration was increased by concentrating the reference solution. The results are shown in FIG. 3. In this case, the solubility of NaCl is about 26%. Therefore, the maximum chlorine concentration is 30 times.

As shown in FIG. 3, the A3003 alloy core material has a potential of −620 mV in the reference solution. Since the sacrificial anode material exhibits a sacrificial anode effect in the normal corrosive solution if the potential of the sacrificial anode material clad on the core material has a potential of at least 100 mV lower than the potential of the core material, the potential of the sacrificial anode material in the normal corrosive solution must be −720 mV or less.

In the high-concentration corrosive water in which the NaCl concentration was increased by 30 times by concentrating the normal corrosive solution, the potential of the A3003 alloy is about −780 mV, which is 160 mV lower than the potential in the normal corrosive solution. Therefore, in order to obtain sufficient corrosion resistance in the corrosive environment assuming a high concentration of corrosive water, the potential of the sacrificial anode material in the normal corrosive solution must be lower than the potential of the A3003 alloy core material in the high-concentration corrosive water, specifically, the potential of the sacrificial anode material in the normal corrosive solution must be lower than −780 mV.

From these results, the tube material can be provided with excellent corrosion resistance by a configuration in which the tube material is formed of a core material and an Al—Zn alloy layer clad on the outer surface of the core material, the potential of the Al—Zn alloy layer in the normal corrosive solution is at least 100 mV lower than the potential of the core material in the normal corrosive solution, and the potential of the Al—Zn alloy layer in the normal corrosive solution is lower than the potential of the core material in the high-concentration corrosive water.

Figure 4:
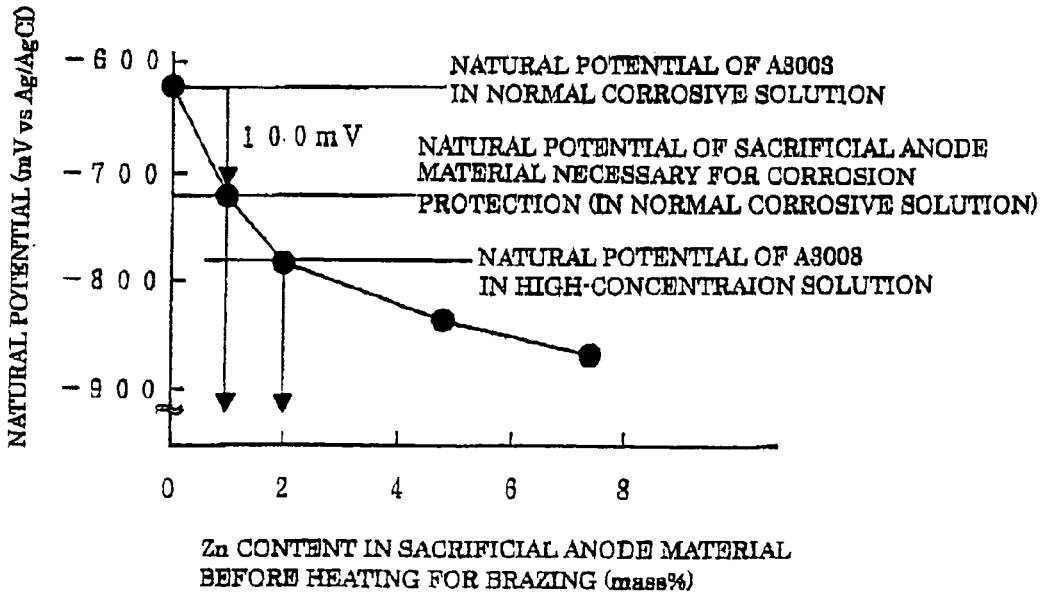
FIG. 4 is a view showing the relationship between a natural potential after heating for brazing and the Zn concentration in an Al—Zn alloy of a tube material on which an Al—Zn alloy is clad.

FIG. 4 shows measurement results for the natural potential in the normal corrosive solution after heating a tube material in which an Al—Zn alloy having a different Zn content was clad on an A3003 alloy core material to a brazing temperature (600° C.). As shown in FIG. 4, the Zn concentration in the sacrificial anode material must be 1.0% or more in order to allow the Al—Zn alloy sacrificial anode material to have a potential of at least 100 mV lower than the potential of the A3003 alloy core material, specifically, to have a potential of no more than −720 mV in the normal corrosive solution.

As shown in FIG. 3, the potential of the A3003 alloy is −780 mV in the high-concentration corrosive water in which the NaCl concentration was increased by 30 times by concentrating the normal corrosive solution. Therefore, the potential of the sacrificial anode material in the normal corrosive solution is lower than −780 mV in order to obtain sufficient corrosion resistance in the corrosive environment assuming high-concentration corrosive water. Therefore, the Zn concentration in the sacrificial anode material must be 2.0% or more. If the Zn concentration exceeds 7.5%, preferential corrosion may occur in the brazed section. Therefore, the suitable range of the Zn concentration in the Al—Zn alloy sacrificial anode material is preferably 2.0-7.5%.

In the present invention, an aluminum alloy which includes 1.0-2.0% of Mn or 1.0-2.0% of Mn and 0.05-0.6% of Cu, and further includes 1.0% or less of Si, 0.7% or less of Fe, and 0.1% or less of Zn as impurities, or an aluminum alloy in which 0.2% or less of Ti or 0.5% or less of Mg is added to the above aluminum alloy may be used as the core material of the tube material.

As the sacrificial anode material which is clad on the tube material, an aluminum alloy which includes 2.0-7.5% of Zn, and may further include 2.0% or less of Si, 0.4% or less of Fe, 0.2% or less of Cu, 2.0% or less of Mn, 0.3% or less of Mg, and 0.2% or less of Ti may be used.

It is still more preferable to use an Al—Mn alloy which includes more than 1.5%, but 2.0% or less of Mn, and preferably 1.6-2.0% of Mn as the core material, and an Al—Zn alloy which includes 2.0-7.5% of Zn, and preferably 2.5-7.5% of Zn as the sacrificial anode material. This combination allows the potential of the Al—Zn alloy layer in the normal corrosive solution to be at least 150 mV lower than the potential of the core material in the normal corrosive solution, and the potential of the Al—Zn alloy layer in the normal corrosive solution to be 50 mV lower than the potential of the core material in the high-concentration corrosive water, whereby an aluminum heat exchanger having excellent corrosion resistance in which the corrosion resistance of the tube material is significantly improved can be obtained.

Mn added to the core material increases the potential of the core material. The potential of the core material is increased as the Mn content is increased. Since Mn is rarely diffused even if heating for brazing is performed, Mn moves from the interface between the core material and the sacrificial anode material only to a small extent. Zn added to the sacrificial anode material is diffused into the core material by heating for brazing to form a diffusion layer from the surface in the direction of the depth. As a result, the concentration gradient of Zn, specifically, potential gradient occurs from the surface in the direction of the depth, whereby the surface of the tube material is protected against corrosion. Since Mn is distributed only on the side of the core material from the interface before heating for brazing (hereinafter called "interface before brazing"), the potential gradient is rapidly increased at the interface before brazing, and corrosion which has proceeded from the surface stops at the interface before brazing. In order to obtain this effect, it is preferable to add Mn to the core material in an amount of more than 1.5%, and still more preferably 1.6% or more.

The present invention is effective when applied to a heat exchanger in which the tube material is formed by bending a two-layer clad sheet in which an Al—Zn alloy layer (sacrificial anode material) is clad on an aluminum alloy core material so that the Al—Zn alloy layer (sacrificial anode material) is on the outer surface, and an aluminum fin material is assembled and brazed to the Al—Zn alloy layer (sacrificial anode material) on the outer surface of the tube material, or to a heat exchanger in which the tube material is formed by bending a three-layer clad sheet in which an Al—Zn alloy layer (sacrificial anode material) is clad on one side of an aluminum alloy core material and an Al—Si alloy filler metal is clad on the other side so that the Al—Zn alloy layer (sacrificial anode material) is on the outer surface and the Al—Si alloy filler metal is on the inner surface, an aluminum fin material is assembled and brazed to the Al—Zn alloy layer (sacrificial anode material) on the outer surface of the tube material, and an aluminum fin material is assembled and brazed on the inner surface.

In the case of using the tube material formed of the two-layer clad material, corrosion resistance is effectively obtained by adjusting the thickness of the tube material to 100-300 μm, and the thickness of the sacrificial anode material to 10-40% of the thickness of the tube material. In the case of using the tube material formed of the three-layer clad material, corrosion resistance is effectively obtained by adjusting the thickness of the tube material to 100-300 μm, the thickness of the sacrificial anode material to 10-40% of the thickness of the tube material, and the thickness of the filler metal to 5-30% of the thickness of the tube material.

Figure 6:
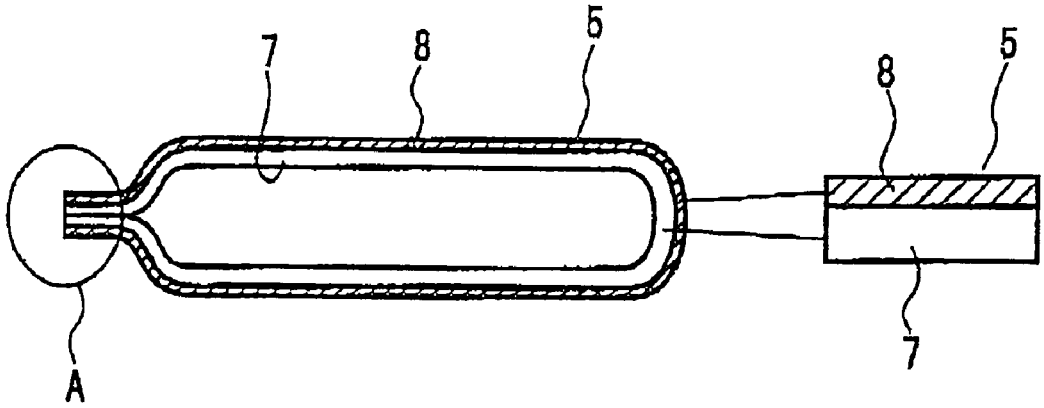
FIG. 6 is a cross-sectional view showing an example of a tube material of the present invention.

As the form of the tube material formed of the two-layer clad material, as shown in FIG. 6, a tube material 5 which is formed by bending a two-layer clad sheet which includes a core material 7 and an Al—Zn alloy layer 8 clad on the core material 7, and mechanically joining, such as staking, both ends in a section A shown in FIG. 6 can be given.

Figure 7:
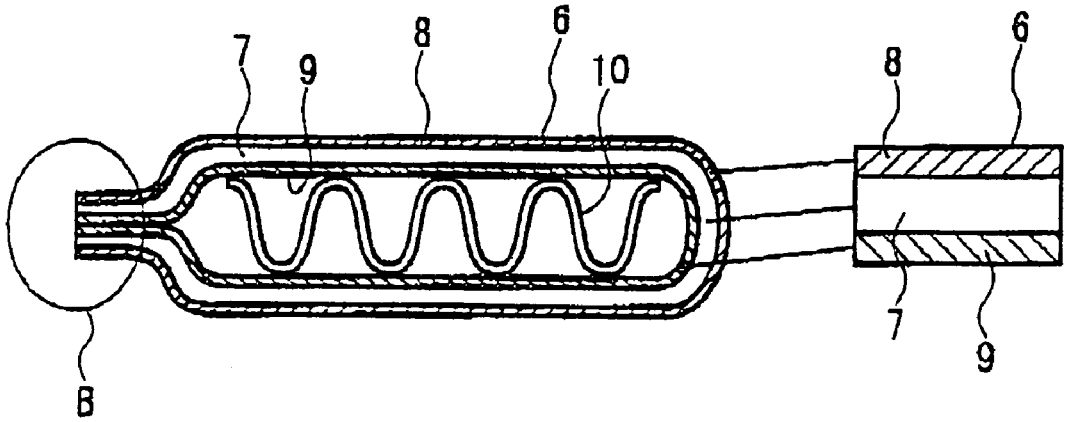
FIG. 7 is a cross-sectional view showing another example of a tube material of the present invention.

As the form of the tube material formed of the three-layer clad material, as shown in FIG. 7, a tube material 6 which is formed by bending a three-layer clad sheet in which an Al—Si alloy filler metal 9 is further clad on the core material 7 of the two-layer clad sheet, and an aluminum fin 10 is assembled, and mechanically joining, such as staking, both ends in a section B shown in FIG. 7 can be given.

Corrosion in the brazed section between the fin material and the tube material is described below. A product formed by corrugating a brazing sheet in which an A4045 alloy filler metal was clad on an Al—Mn alloy core material was used as the fin material, and a sheet material in which an Al-2.0% Zn alloy was clad on an A3003 alloy core material was used as the tube material.

Figure 5:
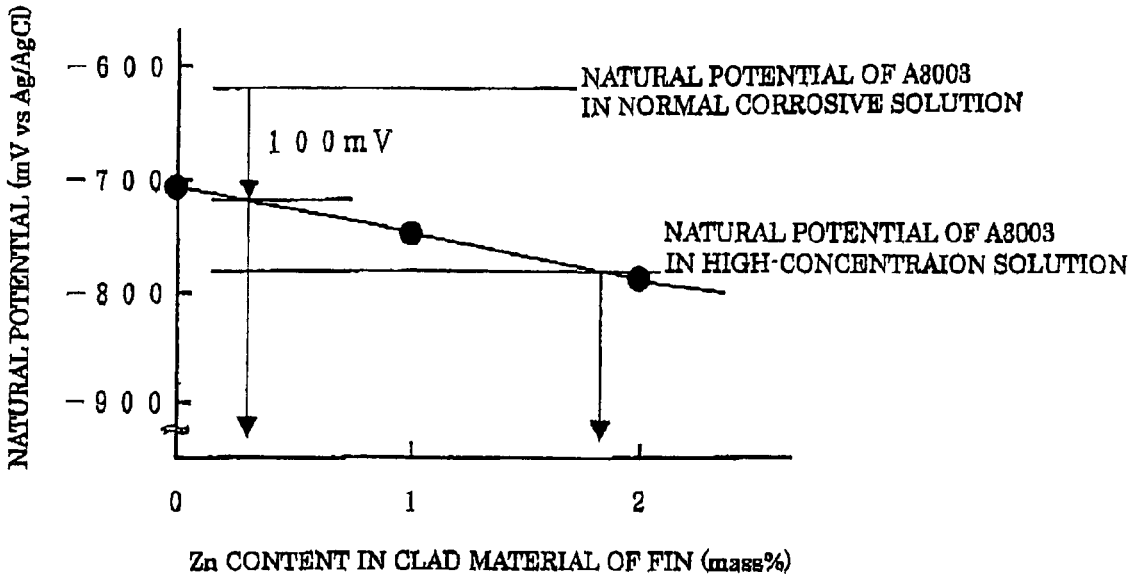
FIG. 5 is a view showing the relationship between a natural potential of an alpha phase in a brazed section after brazing and the Zn concentration in a filler metal of a fin material on which a filler metal is clad.

The fin material and the tube material were assembled and brazed by inert gas brazing using a fluoride-type flux. Since it is difficult to measure the potential of the brazed section, a method in which the brazed section is electrolyzed to corrode the eutectic phase, and the potential of the alpha phase removed is measured was used. The potential of the alpha phase measured was about −700 mV. As the corrosive water, a solution to which 10 g/l of NaCl and 0.3 g/l of $Na_2SO_4$ were added was used. FIG. 5 shows the relationship between the amount of Zn added to the filler metal of the fin material and the natural potential of the alpha phase in the normal corrosive solution.

A brazing sheet, in which a filler metal, in which 1.0% of Zn was added to an A4045 alloy, was clad on an Al—Mn alloy core material, was used as the fin material, and the potential of the alpha phase was measured in the same manner as described above. As a result, the potential of the alpha phase was −750 mV. Therefore, it was confirmed that the addition of Zn to the filler metal decreases the potential of the alpha phase of the filler metal and improves the sacrificial corrosion effect of the fin material, as shown in FIG. 5.

In order to sufficiently protect the core material of the tube material against corrosion, the potential of the alpha phase of the filler metal of the fin material must be at least 100 mV lower than the potential of the A3003 alloy core material of the tube material in the normal corrosive solution. Therefore, 0.3% or more of Zn must be added to the filler metal of the fin material, as shown in FIG. 5. As shown in FIG. 5, Zn is preferably added to the filler metal of the fin material in an amount of 1.8% or more, taking the concentration of the corrosive water into consideration.

If the potential of the alpha phase of the filler metal of the fin material is significantly higher than the potential of the sacrificial corrosion material of the tube material, consumption of the sacrificial corrosion material of the tube material is increased to a large extent, whereby the corrosion life of the tube material is decreased. Since the suitable range of the Zn concentration in the filler metal of the fin material differs depending on the Zn content in the sacrificial corrosion material of the tube material, the same measurement as described above was performed while changing the Zn content in the sacrificial corrosion material of the tube material to 1.0%, 2.0%, 5.0%, and 7.5% assuming various types of corrosive environments. As a result, it was confirmed that excellent corrosion resistance is obtained in the case of adding 0.3-3.0%, and preferably 1.0-3.0% of Zn to the filler metal of the fin material.

In the case of adding Zn to the filler metal of the fin material in an amount of 4.0%, the amount of dissolution of the core material of the fin material is increased by the filler metal. Therefore, it is difficult to form a normal brazed section even if the brazing temperature is decreased. Zn in the filler metal of the fin material is diffused into the core material of the fin material during heating for brazing, whereby the amount of Zn is decreased. In order to prevent the decrease in the amount of Zn, it is still more preferable to add Zn to the filler metal of the fin material in an amount (0.3-3.0%) equal to or greater than that of the core material of the fin material.

The above-described example illustrates the case where the brazing sheet, in which the Al—Si A4045 alloy filler metal is clad on the Al—Mn alloy core material, is applied as the fin material. However, an Al—Mn alloy fin material (bare fin) may be used as the fin material, and the fin material and the tube material may be brazed by applying powdered filler metal to the brazing section.

EXAMPLES

The present invention is described below by examples and comparative examples to demonstrate the effects of the present invention. However, the following examples illustrate only one embodiment of the present invention. The present invention is not limited to these examples.

Example 1

An aluminum alloy containing 0.5% of Si, 0.6% of Fe, 1.2% of Mn, 0.1% of Cu, 0.05% of Zn, and 0.02% of Ti, the balance being Al and unavoidable impurities, was used as an aluminum alloy for a core material of a tube material, and an aluminum alloy containing 2.5% of Zn, 0.4% of Si, 0.5% of Fe, 0.1% of Cu, the balance being Al and unavoidable impurities, was used as an aluminum alloy for a sacrificial anode material of the tube material. The aluminum alloys were cast by semicontinuous casting. The resulting ingots were homogenized and hot-rolled. The hot-rolled products were stacked and hot-rolled to obtain a clad material. The clad material was cold-rolled, process-annealed, and subjected to final cold rolling to obtain a tube material (sheet material) with a thickness of 0.15 mm (specimen No. 1).

A hot-rolled product of the above aluminum alloy for a core material was used as an aluminum alloy for a core material of the tube material. An aluminum alloy containing 5.0% of Zn, 7.5% of Si, 0.4% of Fe, 0.2% of Cu, the balance being Al and unavoidable impurities as an aluminum alloy for a sacrificial anode material of the tube material was cast by semicontinuous casting. The resulting ingot was homogenized and hot-rolled. The hot-rolled product was stacked on the hot-rolled product of the aluminum alloy for a core material and hot-rolled to obtain a clad material. The clad material was cold-rolled, process-annealed, and subjected to final cold rolling to obtain a tube material (sheet material) with a thickness of 0.15 mm (specimen No. 2).

An aluminum alloy containing 0.3% of Si, 0.3% of Fe, 1.0% of Mn, 0.1% of Cu, 1.0% of Zn, and 0.01% of Ti, the balance being Al and unavoidable impurities was used as an aluminum alloy for a core material of a fin material, and an A4045 alloy (10% of Zn, 0.4% of Fe, 0.1% of Cu, 0.02% of Mn, and 1.0% of Zn, the balance being Al and unavoidable impurities) was used as an aluminum alloy for a filler metal of the fin material. The aluminum alloys were cast by semicontinuous casting. The aluminum alloy ingot for the core material was homogenized and hot-rolled. The aluminum alloy for a filler metal was hot-rolled. The resulting products were stacked and hot-rolled to obtain a clad material. The clad material was cold-rolled, process-annealed, and subjected to final cold rolling to obtain a clad fin material (H14 temper) with a thickness of 0.10 mm.

The resulting clad fin material was corrugated. A mini core (miniature model of heat exchanger core) was formed by assembling the corrugated fin with each of the tube materials of the specimens No. 1 and No. 2, and brazing the fin and the tube material. Brazing was performed by applying a fluoride-type flux (concentration: 3%) and heating the mini core at 600° C. for five minutes in a nitrogen gas atmosphere in the same manner as the brazing conditions using a fluoride-type flux.

The mini core after brazing was subjected to the controlled potential electrolysis test (applied potential: −570 mV vs Ag/AgCl, corrosive solution: aqueous solution to which 10 g/l of NaCl and 0.3 g/l of $Na_2SO_4O$ were added). As a result, penetration corrosion did not occur during four days of test in the mini core in which the specimen No. 1 was used as the tube material. On the other hand, penetration corrosion occurred after three days of test in the mini core in which the specimen No. 2 was used as the tube material.

Example 2

An aluminum alloy containing 0.75% of Si, 0.18% of Fe, 1.65% of Mn, 0.3% of Cu, 0.75% of Zn, and 0.14% of Ti, the balance being Al and unavoidable impurities was as an aluminum alloy for a core material of a tube material, and an aluminum alloy containing 2.9% of Zn, 0.4% of Si, 0.4% of Fe, 0.1% of Cu, the balance being Al and unavoidable impurities was used as an aluminum alloy for a sacrificial anode materials of the tube material. The aluminum alloys were cast by semicontinuous casting. The resulting ingots were homogenized and hot-rolled. The hot-rolled products were stacked and hot-rolled to obtain a clad material. The clad material was cold-rolled, process-annealed, and subjected to final cold rolling to obtain a tube material (sheet material) with a thickness of 0.2 mm (specimen No. 3). The thickness of the sacrificial anode material layer was 20% of the entire thickness.

An aluminum alloy containing 0.4% of Si, 0.3% of Fe, 1.2% of Mn, 0.1% of Cu, 1.15% of Zn, 0.08% of Cr, and 0.01% of Ti, the balance being Al and unavoidable impurities was used as an aluminum alloy for a core material of a fin material, and an A4045 alloy (10% of Zn, 0.4% of Fe, 0.1% of Cu, 0.02% of Mn, and 1.0% of Zn, the balance being Al and unavoidable impurities) was used as an aluminum alloy for a filler metal of the fin material. The aluminum alloys were cast by semicontinuous casting. The aluminum alloy ingot for the core material was homogenized and hot-rolled. The aluminum alloy for a filler metal was hot-rolled. The resulting products were stacked and hot-rolled to obtain a clad material. The clad material was cold-rolled, process-annealed, and subjected to final cold rolling to obtain a clad fin material (H14 temper) with a thickness of 0.05 mm.

The resulting clad fin material was corrugated. A mini core (miniature model of heat exchanger core) was formed by assembling the corrugated fin with the tube material of the specimen No. 3, and brazing the corrugated fin and the tube material. Brazing was performed by applying a fluoride-type flux (concentration: 3%) and heating the mini core at 600° C. for five minutes in a nitrogen gas atmosphere in the same manner as the brazing conditions using a fluoride-type flux.

The mini core after brazing was subjected to the controlled potential electrolysis test (applied potential: −570 mV vs Ag/AgCl, corrosive solution: aqueous solution to which 10 g/l of NaCl and 3 g/l of $Na_2SO_4O$ were added). As a result, penetration corrosion did not occur during six days of test in the mini core in which the specimen No. 3 was used as the tube material.

Obviously, numerous modifications and variations of the present invention are possible in light of the above teachings. It is therefore to be understood that, within the scope of the appended claims, the invention may be practiced otherwise than as specifically described herein.

What is claimed is:

1. An aluminum heat exchanger comprising tubes and fins brazed to an outer surface of the tubes and having excellent corrosion resistance which is assembled by brazing an aluminum fin material to an outer surface of a tube material made of aluminum or an aluminum alloy and formed by bending a sheet material, wherein the tube material is formed of a two-layer clad sheet which includes a core material and an Al—Zn alloy layer clad on the core material, the Al—Zn alloy layer having from 2.0-7.5 mass % Zn and no more than 2.0 mass % Si, the Al—Zn alloy layer is clad on the outer surface of the tube material and brazed to the aluminum fin material, the potential of the Al—Zn alloy layer in normal corrosive solution is at least 100 mV lower than the potential of the core material in the normal corrosive solution, and the potential of the Al—Zn alloy layer in the normal corrosive solution is lower than the potential of the core material in high-concentration corrosive water, provided that the normal corrosive solution refers to an aqueous solution containing 10 g/l of NaCl and 0.3 g/l of $Na_2SO_4$, and the high-concentration corrosive water refers to an aqueous solution in which the NaCl concentration is increased by 30 times by concentrating the above aqueous solution.

2. The aluminum heat exchanger having excellent corrosion resistance according to claim 1, wherein the potential of a brazed section between the Al—Zn alloy layer of the tube material and the aluminum fin material in the normal corrosive solution is at least 100 mV lower than the potential of the core material in the normal corrosive solution, and the potential of the brazed section between the Al—Zn alloy layer of the tube material and the aluminum fin material in the normal corrosive solution is equal to or lower than the potential of the core material of the tube material in the high-concentration corrosive water.

3. The aluminum heat exchanger having excellent corrosion resistance according to claim 1, wherein the core material of the tube material is an Al—Mn alloy.

4. The aluminum heat exchanger having excellent corrosion resistance according to claim 3, wherein the Al—Mn alloy comprises more than 1.5% of Mn.

5. The aluminum heat exchanger having excellent corrosion resistance according to claim 1, wherein the tube material has a thickness of 100-300 μm, and the thickness of the Al—Zn alloy layer is 10-40% of the thickness of the tube material.

6. The aluminum heat exchanger having excellent corrosion resistance according to claim 1, wherein the aluminum fin material has an Al—Si alloy filler metal clad thereto and is brazed to an inner surface of the tube material.

7. The aluminum heat exchanger having excellent corrosion resistance according to claim 1, wherein the tube material is formed of a three-layer clad sheet in which an Al—Si alloy filler metal is further clad on the core material of the two-layer clad sheet, the Al—Si alloy filler metal is clad on the inner surface of the tube material, and the aluminum fin material is brazed to the inner surface of the tube material.

8. The aluminum heat exchanger having excellent corrosion resistance according to claim 7, wherein the tube material has a thickness of 100-300 μm, the thickness of the Al—Zn alloy layer is 10-40% of the thickness of the tube material, and the thickness of the Al—Si alloy filler metal is 5-30% of the thickness of the tube material.

9. The aluminum heat exchanger having excellent corrosion resistance according to claim 1, wherein the aluminum fin material on which an Al—Si alloy filler metal is clad is brazed to the outer surface of the tube material.

10. The aluminum heat exchanger having excellent corrosion resistance according to claim 9, wherein at least one of the Al—Si alloy filler metal and the aluminum fin material comprises 0.3-3.0% of Zn.

11. The aluminum heat exchanger having excellent corrosion resistance according to claim 1, wherein the aluminum fin material is brazed to the outer surface of the tube material using a powdered filler metal.

12. The aluminum heat exchanger having excellent corrosion resistance according to claim 11, wherein the aluminum fin material comprises 0.3-3.0% of Zn.

13. The aluminum heat exchanger having excellent corrosion resistance according to claim 1, wherein the Al—Zn alloy contains Si in an amount less than 2.0 mass %.

* * * * *